US010093890B2

(12) United States Patent
Mesa

(10) Patent No.: US 10,093,890 B2
(45) Date of Patent: Oct. 9, 2018

(54) LAUNDRY DETERGENT, FABRIC SOFTENER AND CLEANING FORMULATIONS, SYSTEMS, AND WATER-SOLUBLE POUCHES

(71) Applicant: Domingo A. Mesa, Norridge, IL (US)

(72) Inventor: Domingo A. Mesa, Norridge, IL (US)

( * ) Notice: Subject to any disclaimer, the term of this patent is extended or adjusted under 35 U.S.C. 154(b) by 0 days.

(21) Appl. No.: 14/935,626

(22) Filed: Nov. 9, 2015

(65) Prior Publication Data

US 2016/0201017 A1 Jul. 14, 2016

Related U.S. Application Data

(60) Provisional application No. 62/101,246, filed on Jan. 8, 2015.

(51) Int. Cl.
*C11D 17/04* (2006.01)
*C11D 3/20* (2006.01)
*C11D 3/00* (2006.01)

(52) U.S. Cl.
CPC ..... *C11D 17/043* (2013.01); *C11D 3/0015* (2013.01); *C11D 3/0094* (2013.01); *C11D 17/045* (2013.01)

(58) Field of Classification Search
CPC ..... C11D 1/00; C11D 17/00; B65D 81/00; B65D 23/00
USPC ..... 510/218
See application file for complete search history.

(56) References Cited

U.S. PATENT DOCUMENTS 4,937,416 A 11/1990 Kennedy
6,037,319 A 3/2000 Dickler et al.
6,362,156 B1 * 3/2002 Hsu ..... C11D 1/83 510/337
6,506,717 B1 * 1/2003 Kott ..... C11D 1/22 510/357
6,583,096 B1 * 6/2003 Kott ..... C11D 1/22 510/357
6,624,130 B2 9/2003 Giblin et al.
6,683,038 B2 6/2004 Forth et al.
7,091,171 B2 8/2006 Caswell et al.
7,179,780 B2 2/2007 Forth et al.
7,186,680 B2 3/2007 Caswell et al.
7,273,841 B2 9/2007 Colurciello et al.
7,304,023 B2 12/2007 Dasque et al.
7,521,411 B2 4/2009 Sharma et al.
7,544,651 B2 6/2009 Caswell et al.
7,652,856 B2 1/2010 Pinarbasi
8,156,713 B2 4/2012 Catlin et al.
8,357,647 B2 1/2013 Sharma et al.
8,992,632 B2 3/2015 Holzhauser et al.
9,139,798 B2 9/2015 Holzhauser et al.
2005/0119151 A1 * 6/2005 Mayer ..... C11D 3/37 510/476
2006/0123557 A1 6/2006 Caswell et al.
2006/0281658 A1 12/2006 Kellar et al.
2006/0293447 A1 * 12/2006 Wiedemann ..... C11D 17/042 525/57
2010/0196287 A1 * 8/2010 O'Connell ..... A61K 8/37 424/50
2011/0186468 A1 * 8/2011 Denome ..... B65D 65/46 206/524.7
2014/0148371 A1 * 5/2014 Man ..... C11D 1/75 510/407
2014/0148372 A1 * 5/2014 Man ..... C11D 1/75 510/407
2015/0218488 A1 * 8/2015 Man ..... C11D 1/75 510/161
2016/0201017 A1 * 7/2016 Mesa ..... C11D 17/043 510/218

FOREIGN PATENT DOCUMENTS

EP 2441824 4/2012
WO 2013177136 11/2013

* cited by examiner

*Primary Examiner* — Nicole M Buie-Hatcher
*Assistant Examiner* — M. Reza Asdjodi
(74) *Attorney, Agent, or Firm* — Scherrer Patent & Trademark Law, P.C.; Stephen T. Scherrer; Monique A. Morneault

(57) ABSTRACT

Water soluble packets containing cleaning concentrates in gel form in unit dose, ready-to-use and pouches to be reconstituted in ready-to-use cleaners and fabric treatment products are provided. The packaging system, direct-over-package and shipping and display package are constructed of biodegradable, compostable and recyclable components. The packets are stable despite the fact that the cleaning formulas for laundry and manual dishwashing contain more than 24% of water by weight. The reconstitution system is comprised of a container and a mixer, manual or powered, specifically designed to prevent foam formation during the reconstitution process while producing a shearing effect to cut the concentrated gels into easy to disperse pieces, although various embodiments described herein do not require the use of a mixing device for reconstitution. All components of the system are: biodegradable, compostable, recyclable, or reusable, leading to near zero waste to the environment.

13 Claims, No Drawings

LAUNDRY DETERGENT, FABRIC SOFTENER AND CLEANING FORMULATIONS, SYSTEMS, AND WATER-SOLUBLE POUCHES

The present invention claims priority to U.S. Provisional Patent Application No. 62/101,246, titled "Laundry Detergent and Fabric Softener Cleaning Formulations, Systems, and Water-Soluble Pouches," filed Jan. 8, 2015, which is incorporated herein by reference in its entirety.

TECHNICAL FIELD

Water soluble packets containing cleaning concentrates in gel form and emulsions of various viscosities in unit dose, ready-to-use and pouches, and in single or multi-chamber units to be reconstituted as ready-to-use cleaners and fabric treatment products are provided. The packaging system, direct-over-package and shipping and display package are constructed of biodegradable, compostable and recyclable components. The packets are stable despite the fact that the cleaning formulas for laundry and manual dishwashing contain more than 24% of water by weight. The reconstitution system is comprised of a container and a mixer, manual or powered, specifically designed to prevent foam formation during the reconstitution process while producing a shearing effect to cut the concentrated gels into easy to disperse pieces, although some embodiments do not require the use of a mixing device for reconstitution. All components of the system are: biodegradable, compostable, recyclable, or reusable, leading to near zero waste to the environment.

BACKGROUND

The use of concentrated cleaning products and fabric care products is well known. Concentrated cleaning products have been delivered in several variations of the following forms: concentrated powders, concentrated gels, concentrated pastes, and concentrated liquids.

Concentrated liquid, pastes and gels are delivered in ready-to-use forms and for reconstitution into ready-to-use products by addition of water. The reconstituted laundry detergent and dishwashing liquid products typically do not produce the viscosity desired by the consumer. The delivery system, refill system or direct-over-package systems are typically not biodegradable.

Liquid and gels formulations for direct application by measuring cup and dispensing pumps, said 2× and above, are generally in conflict with the consumer habits of larger volume application. This leads to over-using the product and, therefore, product usage cost increases. It also leads to higher use of plastic containers and a large amount of waste to the environment.

Laundry detergent sachets in unit dosage have a disadvantage over measurable liquids due to the nature of their discontinuity that is the dosage cannot be adjusted higher or lower without opening another unit dose. This increases the usage cost in some applications and produces a shortage of detergent requirements in other applications. Pre-dosed unites of dish-washing detergents for machine applications generally do not present the disadvantage noted above. However, the use of high foaming detergents is typically limited without proper defoaming agents. Machine dish-washing formulas in powder form generally make use of high alkalinity salts and silicates, which are typically abrasive to fine glass. Moreover, pre-dosed fabric softeners that are added to wash cycles have the disadvantage of losing efficiency due to several factors, such as dirt on the fabric and excessive rinsing.

Pouches of products in water soluble film need to be protected from moisture. Specifically, the moisture of the environment needs to be kept as constant as possible during storage, transportation and use. For this purpose manufacturers use re-closable plastic bags with moisture barriers or plastic containers as over-package. These materials are not biodegradable, some are recyclable to an extent and some are not.

The concentrated powders are generally dusty, which can expose the consumer to ingestion by inhalation and present solubility problems. Powders, unlike liquids or gels, have limited use as pre-spotters in laundry applications.

Fabric softeners cannot be concentrated as much as laundry formulas due to the high viscosity of concentrations over 20% of active material. High viscosity is not a desirable feature for the fabric softeners due to the short release time from the product dispensing system during the application cycle.

The laundry formulas packaged in water soluble film contain organic solvent and generally between less than 7% water per weight, as described in U.S. Pat. No. 6,037,319, or organic solvent and between 10% water by weight and 24% water by weight, as described in U.S. Pat. No. 4,973,416, or do not contain organic solvent and contain a water content of at least 35% by weight, as described in Patent Application Publication No. US 2006/0281658.

None of the above disclosures relate to a viscous gel containing no organic solvent, or containing little organic solvent as a viscosity modifier and a detergency enhancer, and with a water content of between 25% and less than 30% by weight. Also, none of the above-referenced disclosures relate to formulas containing dissolved and particulate salt with the dual purpose of reducing the effective concentration of water, also known as water activity, and serving as a reserve to produce a thick ready-to-use end product that satisfies consumer expectations on viscosity, such as, for example, a viscous liquid of between 400 Centipoise and 1,500 Centipoise. Moreover, none of the above-referenced disclosures relate to using a dish detergent containing high foaming surfactants aided by a silicone-based or other type of defoamer in a multi-chamber pouch or packet to be used in machine dish washing applications.

Heretofore, there are no known formulations containing a fabric softener concentrate paste having a latent state thickener, which will swell (e.g., form a hydrogel-upon reconstitution with water producing a ready-to-use viscous product of viscosity between 200 Centipoise and 400 Centipoise). Viscosity range can be extended up and/or down by the use of controlled amount of the polysaccharide in the formula. In addition, none of the disclosures relate to formula without polysaccharide to allow the use of the system as a single dose that is reconstituted with water in the fabric softener application wells of laundry machines.

Moreover, heretofore, there are no known disclosures describing the use of cellophane film, polylactic acid film, or wax or biodegradable polymer-coated paper to protect the moisture environment of cleaning products packaged in water soluble films.

In addition, there are no known disclosures of a mixing system, manual or powered, that produces a chopping action to aid in: 1) the dispersion of the concentrated material; and 2) solubilization of the salts and prevention of foam formation in the products during the reconstitution step.

SUMMARY OF THE INVENTION

Water soluble packets containing cleaning concentrates and fabric treatment products in gel form and emulsions of various viscosities in unit dose, ready-to-use and pouches to be reconstituted in ready-to-use cleaners and fabric treatment products are provided. The packaging system, direct-over-package and shipping and display package are constructed of biodegradable, compostable and recyclable components. The packets are stable despite the fact that the cleaning formulas for laundry and manual dishwashing contain more than 24% of water by weight. The reconstitution system is comprised of a container and a mixer, manual or powered, specifically designed to prevent foam formation during the reconstitution process while producing a shearing effect to cut the concentrated gels into easy to disperse pieces, although modifications of the formulas disclosed herein may allow for the omission of the mixing device for reconstituting into ready-to-use products. All components of the system are: biodegradable, compostable, recyclable, or reusable, leading to near zero waste to the environment.

To this end, in an embodiment of the present invention, laundry detergent formulas in gel form or emulsions of various viscosities is provided. The laundry detergent formula in gel or emulsion form comprises a package made of water soluble material in film form; an aqueous gel containing from 24% to less than 30% by weight of water and no organic solvent or less than 20% by weight organic solvent as viscosity control agent and/or detergency enhancer; and salt in dissolved and un-dissolved state, said salt serving to reduce the effective concentration of water contained in a package, said package a pouch or packet of a unit dose of a said gel or contained in a package, said package a pouch containing a quantity of product to be reconstituted with water, 5 to 7 times said pouch weight, into a ready-to-use laundry detergent viscous liquid, said package comprising a water soluble film material that dissolves when placed in the laundry wash water and water of reconstitution releasing the laundry detergent gel, said water soluble film forming material being in direct contact with the laundry detergent maintains its structural integrity prior to the addition to water due to the critical level in the formula of dissolved and un-dissolved salt, other ionic organic components and emulsifications of water.

In an alternate embodiment of the present invention, dishwashing detergents formula in gel and emulsion form is provided. The hand dishwashing detergent formula comprises a package made of water soluble material in film form; an aqueous gel containing from 24% to less than 30% by weight of water and no organic solvent or less than 20% by weight organic solvent as viscosity control agent and/or detergency enhancer; and salt in dissolved and un-dissolved state, said salt serving to reduce the effective concentration of water contained in a package, said package a pouch containing a quantity of product to be reconstituted with water, 3 to 4 times said pouch weight, into a ready-to-use hand dishwashing detergent viscous liquid, said package comprising a water soluble film material that dissolves when placed in the water of reconstitution releasing the hand dishwashing detergent gel, said water soluble film forming material being in direct contact with the hand dishwashing detergent maintains its structural integrity prior to the addition to water due to the critical level in the formula of dissolved and un-dissolved salt, other ionic organic components and emulsifications of water. The dishwashing formulas, when packaged in single use doses in water-soluble film, may be packaged in a dual chamber packet so that one of the chambers contain a silicone based or other type of defoamer, such as, for example, polyalkylene glycol based defoamer, to allow for the use of the high foam formulas in low foam applications, such as in automatic dish washing machine, ultrasonic washing machine and pre-soaking systems.

In an alternate embodiment of the present invention, a fabric softener formula in paste form is provided. The fabric softener in paste form comprises a package made of water soluble material in film form; a non-aqueous paste containing from 3% to 5% of a polysaccharide dispersed in two fabric softener compounds, one of the compounds serving the purpose of carrier and imparting some fabric softening characteristics, which is contained in a package, said package a pouch containing a quantity of product to be reconstituted with water, 5 to 7 times said pouch weight, into a ready-to-use fabric softener viscous hydrogel, said package comprising a water soluble film material that dissolves when placed in the water of reconstitution releasing the formula ingredients to form a hydrogel of desired viscosity, said water soluble film forming material being in direct contact with the fabric softener formula maintains its structural integrity prior to the addition to water due to the absence in the formula of water and other products that affect the film integrity. This formula may be modified by restricting or eliminating polysaccharide to allow for a ready-to-use product packaged in a packet made from water-soluble film to be reconstituted with water inside the dispensing well of the laundry machine.

In an alternate embodiment of the present invention, a package of the products described above is provided. The package comprises packets or pouches as described above in an over-pack, said over-pack being a re-closable bag of biodegradable or compostable material, printed or non-printed, said over-pack made of layer of films of cellophane, aluminum and/or polylactic acid, each alone or in combination of layers in proportions required to maintain the moisture content of the enclosed environment relatively unchanged, said bags being biodegradable and/or compostable In an alternate embodiment of the present invention, a single bag or multiple bags containing the articles described above is provided. The single bag or multiple bags packaged into a cardboard box for storage, shipping, display and to serve as secondary containment and moisture protection layer at the point of use, said cardboard box made from non-bleached Kraft® paper coated with a biodegradable coating material to protect the content from moisture and being biodegradable and/or compostable, said coating material being wax, preferably from natural sources and non-petroleum-derived or a synthetic biodegradable material as will be described under Detailed Description section of this document.

In an alternate embodiment of the present invention, a reconstitution system is provided. The reconstitution system comprises a reusable container that serves as storage for the reconstituted material and has a measuring and dispensing devise to measure or dispense the reconstituted material, and a manual or powered mixing device that facilitates the dispersion and dissolution of the formulas in the specified volume of water and which operation prevents foam from forming in the ready-to-use product.

DETAILED DESCRIPTION OF THE PRESENTLY PREFERRED EMBODIMENTS

Water soluble packets containing cleaning concentrates in gel and emulsion form in unit dose, ready-to-use and pouches to be reconstituted in ready-to-use cleaners and fabric treatment products are provided. The packaging system, direct-over-package and shipping and display package are constructed of biodegradable, compostable and recyclable components. The packets are stable despite the fact that the cleaning formulas for laundry and dishwashing contain more than 24% of water by weight. The reconstitution system is comprised of a container and a mixer, manual or powered, specifically designed to prevent foam formation during the reconstitution process while producing a shearing effect to cut the concentrated gels into easy to disperse pieces. Modifications of the formulas described herein within the above-mentioned water content may allow for the omission of the mixing device to reconstitute the concentrates into ready-to-use products. All components of the system are: biodegradable, compostable, recyclable, or reusable, leading to near zero waste to the environment.

Formulas, Packaging and Over-Packages

Laundry Formulas

Hydrogel of laundry detergent may contain a mixture of anionic detergents, non-ionic detergents, dissolved and undissolved inorganic salt, fragrance, dyes and may be mixed with other ingredients as to produce alkalinity builders and water softening capabilities. Formula components may be packaged in a single chamber pouch or separated into a multi-chamber pouch or packet.

More specifically, the laundry detergents of the present invention are useful for packaging in water-soluble pouches or packets, as described herein, and may have a relatively high water content. Specifically, the water content may preferably be between about 24% and about 30% by weight of the concentrate formulation; preferably between about 25% and about 29%. The laundry detergents as described herein may further contain a component that reduces the thermodynamic activity of water, such as inorganic sales, such as, for example, an amount of NaCl or similar component. The NaCl, or similar component, may further impact the viscosity of the concentrate when reconstituted in water into a ready-to-use product. The inorganic salt may preferably be present in an amount of between about 0.5% and about 7% by weight, if the final concentrate product is desired without undissolved inorganic salt granules, such as NaCl granules. For a hydrogel in which the viscosity thereof may allow for the suspension of inorganic salt, the salt may be present in an amount up to about 15%.

The laundry formulations described herein may further contain a surfactant or a mixture of anionic and/or nonionic surfactants in an amount of between about 35% and about 65%, preferably about 50%. The surfactants may be selected to aid in their use as laundry detergents, and may include surfactants that are utilized as soil removers, detergents, hydrotropes, dispersing agents, wetting agents, emulsifiers, thickeners, solvents, and for other purposes useful as laundry detergents To influence the viscosity of the concentrate and/or the product when reconstituted in water, an amount of an organic solvent may be utilized, such as, for example, ethanol, isopropyl alcohol, or mixtures of ethanol and isopropyl alcohol and propylene glycol. Preferably, the organic solvent may be present in an amount of between about 0% and 20% by weight. The organic solvent may further be utilized to stabilize the formulations by preventing non-ionic surfactants from separating from the hydrophilic phase, and may be used to increase surfactant efficacy, as known to one of ordinary skill in the art.

Formulas described in this invention may be used for laundry applications. Specifically, packets and pouches for Laundry Formula 1, and preferably pouches for Laundry Formula 2, as discussed in more detail below, may allow the dispersion and suspension, in a homogenized hydrogel, of inorganic salts. The viscosity of the hydrogel is preferably carefully controlled to maintain the particles of salt in suspension, for otherwise the final packaged product may not have the same salt content in all packets, resulting in more or less viscous final products and potentially creating stability problems in the final product, such as, for example, salting out and phase separation.

The following two examples of formulas differ in solid content and viscosity of the hydrogel. They are designed to meet the following criteria:

1—Formula 1 is of higher viscosity than Formula 2—higher solid content—which makes it relatively cost-effective for transportation and production and more difficult to package due to the lower fluidity of the hydrogel. It is preferable that Laundry Formula 1 be packaged into unit dose packets and pouches of larger size to be reconstituted into 5 to 7 times is weight with water to generate a high viscosity ready-to-use laundry detergent. This formula and its modifications within the water content range described herein, may be packaged in multi-chamber, single use water soluble packets and pouches for reconstitution by separating some of its components, such as part of the sodium chloride content.

2—Laundry Formula 2 of lower viscosity than Laundry Formula 1, having a lower solid content but the same detergent content, which makes it cost-effective for transportation and production and easier to package due to the higher fluidity of the hydrogel. Laundry Formula 2 may be preferably packaged into unit dose packets.

Laundry formula 1 contains the following ingredients at said concentration:

| Ingredient | CAS No. | % by weight |
|---|---|---|
| Sodium lauryl ether sulfate with 1, 2 or 3 moles ethylene oxide and 30% water by weight | 9004-82-4 | 50 |
| Sodium dodecyl benzene sulfonate, in powder form | 25155-30-0 | 6 |
| Cocamide DIPA | 68855-69-9 | 14 |
| Linear alcohol ethoxylate (C10-12) | 66455-15-0 | 4.6 |
| Sodium chloride, crystals | 7440-23-5 | 14 |
| Water, soft | 7732-18-5 | 9.6 |
| Fragrance | | 1.4 |
| Dye | | 5 ml/50 lbs of product |

The manufacture process preferably occurs by adding specific ingredients in the following order:

1—Add the water to the manufacturing batch.

2—Add the Sodium dodecyl benzene sulfonate, sodium salt, in powder form to the batch and mix until a homogeneous white paste is formed.

3—Add the Cocamide DIPA followed by the linear alcohol ethoxylate while mixing. A viscous clear to amber colored translucent paste will form.

4—Add the Sodium lauryl ether sulfate with 1, 2 or 3 moles ethylene oxide and 30% water by weight and mix. A very viscous hydrogel will form.

5—Slowly add the Sodium chloride, crystals and mix until there is no indication of clumps.

6—Add the fragrance followed by the dye and mix until the dye is homogeneously dispersed.

The formation of the hydrogel before adding the sodium chloride crystals may preferably be an important step of the process to obtain the desired dispersion of the crystals throughout the product Laundry formula 2 contains the following ingredients at said concentration:

| Ingredient | CAS No. | % by weight |
|---|---|---|
| Sodium lauryl ether sulfate with 1, 2 or 3 moles ethylene oxide and 30% water by weight | 9004-82-4 | 48.34 |
| Sodium dodecyl benzene sulfonate, in powder form | 25155-30-0 | 5.79 |
| Cocamide DIPA | 68855-69-6 | 15.46 |
| Linear alcohol ethoxylate (C10-12) | 66455-15-0 | 4.61 |
| Sodium chloride, crystals | 7440-23-5 | 0.5 |
| Ethanol | 64-17-5 | 11.5 |
| Water, soft | 7732-18-5 | 12.23 |
| Fragrance | | 1.29 |
| Dye | | 5 ml/50 lbs of product |

In the formulas described above, Cocamide DIPA may be substituted with Cocamide MIPA, Cocamide DEA, or its corresponding lauramides. Ethanol may be substituted by isopropyl alcohol, a mixture of ethanol and propylene glycol and/or a mixture of isopropyl alcohol and propylene glycol. Sodium dodecyl benzene sulfonate in powder form can be substituted by its acid liquid version and neutralized with sodium and potassium hydroxide. Modifications may have the water content adjusted to achieve a final product within the scope of this invention, of more than 24% and less than 30% by weight water content. Sodium lauryl ether sulfate with 30% water by weight can be substituted by a version containing water and alcohol having adjustment of water content so that the formula remains within the specified range of more than 24% and less than 30% by weight of the formula.

The manufacture process preferably occurs in the following order:

1. Add the water to the manufacturing batch.
2. Add the Sodium dodecyl benzene sulfonate, sodium salt, in powder form to the batch and mix until a homogeneous white paste is formed.
3. Add the Cocamide DIPA followed by the linear alcohol ethoxylate while mixing. A viscous clear to amber colored translucent paste will form.
4. Add the Sodium lauryl ether sulfate with 1, 2 or 3 moles ethylene oxide and 30% water by weight and mix. A very viscous hydrogel will form.
5. Slowly add the Sodium chloride, crystals and mix until there is no indication of clumps.
6. Add the ethanol and mix to homogenize. The viscosity of the product will decrease.
7. Add the fragrance followed by the dye and mix until the dye is homogeneously dispersed.

The formation of the hydrogel before adding the sodium chloride crystals may preferably be an important step of the process to obtain the desire dispersion of the crystals throughout the product. Even when the viscosity of the hydrogel decreases after the addition of the ethanol, it still will be high enough to maintain the sodium chloride crystals, if any, homogeneously dispersed in the final product.

The articles described under Laundry Formula 1 and Laundry Formula 2 may be packaged in packets of water-soluble film containing, preferably, between 15 grams and 20 grams to be used as unit dose to launder approximately 10 pounds of fabric per application. Adjustments in amount of formula packaged may be made according to the fabric's soil content and other parameters.

Said unit dose is preferably over-packed in a re-closable bag made from biodegradable material, printed or non-printed, said over pack preferably made of layer of films of cellophane, aluminum and/or polylactic acid, each alone or in combination of layers in proportions required to maintain the moisture content of the enclosed environment relatively unchanged, said bags preferably being biodegradable and/or compostable.

Example of the above article for use as films in the present invention include, but are not limited to, for example, NatureFlex™ Biodegradable Clear Cello bag manufactured or distributed by Bags & Bows SE Distributors, 2039 Monier Blvd, Lithia Springs, Ga. 30122

A single bag or multiple bags containing the articles described above may be packaged into a cardboard box for storage, shipping, display and/or to serve as a secondary containment and a moisture protection layer at the point of use, said cardboard box made from non-bleached Kraft® paper coated with a biodegradable coating material to protect the content from moisture and still be biodegradable and compostable. Said coating material can be wax, preferably from natural sources and non-petroleum derived or a synthetic biodegradable material.

An example of the above article for use as a cardboard box is EcoPack manufactured by International Paper, Inc.

The article under Laundry Formula 1 may alternately be packaged in single chamber or multi-chamber packets of water-soluble film containing between about, for example, 200 grams and 225 grams to be reconstituted into a final volume of 1,400 ml and 1,500 ml with tap water, soft water, reverse osmosis produced water, deionized water or distilled water. Larger packets may be produced using stronger films to be reconstituted into 5 to 7 times their weight with tap water, soft water, reverse osmosis produced water, deionized water or distilled water Said packets may be over-packed in re-closable bag made from biodegradable and/or compostable material, printed or non-printed. Said over-pack preferably made of layer of films of cellophane, aluminum, paper and/or polylactic acid, each alone or in combination of layers in proportions required to maintain the moisture content of the enclosed environment relatively unchanged, said bags preferably biodegradable and/or compostable Example of the above article for use in films of the present invention include but are not limited to, for example, NatureFlex™ Biodegradable Clear Cello bag manufactured or distributed by Bags & Bows SE Distributors, 2039 Monier Blvd, Lithia Springs, Ga. 30122.

A single bag or multiple bags containing the articles described above may be packaged into a cardboard box for storage, shipping, display and/or to serve as a secondary containment and a moisture protection layer at the point of use, said cardboard box made from non-bleached Kraft® paper coated with a biodegradable coating material to protect the content from moisture and still be biodegradable and/or compostable, said coating material may be wax, preferably from natural sources and non-petroleum derived or a synthetic biodegradable material.

An example of the above article for use in a cardboard box includes, but is not limited to, EcoPack manufactured by International Paper, Inc.

Fabric Softener Formulas

Fabric softener formulations, according to the present invention, may include formulations useful for use within water-soluble films, as described herein. Specifically, a preferred fabric softener formulation comprises an amount of glycerin or a glycerin/propylene glycol mixture at about a 2.3:1 ratio. Specifically, the glycerin or glycerin/propylene glycol mixture may be present in an amount of about 60% to 73% by weight. Further, the fabric softener formulations of the present invention may comprise an amount of polysaccharide of about 1% to about 5% for reconstitution into a ready-to-use product. However, the formulations may also be formulated without polysaccharide, preferably with the glycerin/propylene glycol mixture, as described above. Further, an amount of fabric softener may be included, for example, Accoquat™ in an amount of between about 5% and about 30%; however, the fabric softener formulation may have no fabric softener composition, and may rely purely on glycerin to soften fabrics. The use of no fabric softener component may be utilized in formulations where the fabric softener may react with anionic surfactants of laundry detergents used in conjunction therewith.

A paste of concentrated fabric softening ingredient, latent stage polysaccharide, fragrance and dyes was prepared as follows:

| Ingredient | CAS No. | % by weight |
|---|---|---|
| Glycerin with a purity of at least 99% | 56-81-5 | 68 |
| Accoquat VEQ HF-85, paste | Proprietary | 25 |
| Guar Gum, non-ionic (Procol U) | 9000-30-0 | 3.5 |
| Fragrance | | 3.5 |
| Dye | | 0.02 |

The manufacturing procedure may preferably be:

1—Load the Glycerin with a purity of at least 99% into the batch.

2—Load the Accoquat VEQ HF-85, paste and mix. A thick paste will form.

3—Add the Guar Gum, non-ionic (Procol U) and mix to homogenize.

4—Add the Fragrance followed by the dye and mix until a homogeneously colored paste is obtained.

Preferably, the Guar Gum may be dispersed without lumps into the paste. If it is not completely dispersed it may form fish-eye during the hydrogel formation step at the time of reconstitution resulting in a lumpy product of low aesthetics. If Guar Gum lumps, it may create deposits of the polysaccharide onto the fabric during the laundry process. For a product to be used in single dose packets of water soluble film, to be reconstituted with water into the fabric softener application wells of the laundry machines, the above-described formula may preferably be modified by decreasing or eliminating the polysaccharide and changing the glycerin to a glycerin/propylene glycol mixture at a 2.3:1 ratio to complete the formula total content to 100%.

The article under Fabric Softener Formula may be packaged in packets of water-soluble film containing between, for example, 170 grams and 200 grams to be reconstituted into a final volume of 1,400 ml and 1,500 ml with tap water, soft water, reverse osmosis produced water, deionized water or distilled water. Larger packets can be produced using stronger films to be reconstituted into 5 to 8 times their weight with tap water, soft water, reverse osmosis produced water, deionized water or distilled water. Moreover, the formula with reduced or without polysaccharide, as described above, may be packaged in single use packets of water-soluble film containing about 12 grams to 25 grams or more of the product of the formula, depending on the size of the equipment in use, to be reconstituted with water in the fabric softener application wells of the laundry machines.

In addition, the formulas of fabric softener described herein, and contained within packets of water soluble film may be reconstituted by adding the packets to a container with an amount of water, and allowing the water-soluble film to dissolve. A mixing apparatus may be utilized to mix the reconstituted fabric softener, and the reconstituted fabric softener may be added to a laundry machine in a laundry cycle. The use of reconstituted fabric softener may be utilized to prevent or minimize the interaction of cationic compounds within the fabric softener from deleteriously reacting or interacting with anionic surfactants contained in laundry formulations, such as the laundry formulations described herein.

Said packets will be over-packed in re-closable bag made from biodegradable material, printed or non-printed, said over-pack preferably made of layer of films of cellophane, aluminum, paper and/or polylactic acid, each alone or in combination of layers in proportions required to maintain the moisture content of the enclosed environment relatively unchanged, said bags may preferably be biodegradable and/or compostable An example of the above article for use in films include, but is not limited to, NatureFlex™ Biodegradable Clear Cello bag manufactured or distributed by Bags & Bows SE Distributors, 2039 Monier Blvd, Lithia Springs, Ga. 30122.

A single bag or multiple bags containing the articles described above may be packaged into a cardboard box for storage, shipping, display and/or to serve as a secondary containment and a moisture protection layer at the point of use, said cardboard box made from non-bleached Kraft® paper coated with a biodegradable coating material to protect the content from moisture and still be biodegradable and/or compostable, said coating material may be wax, preferably from natural sources and non-petroleum derived or a synthetic biodegradable material.

An example of the above article for use as a cardboard box includes, but is not limited to, EcoPack manufactured by International Paper, Inc.

In an alternate embodiment, a dual-pack of water soluble film may have both a laundry formulation, such as the laundry formulation as described above, and a fabric softener formulation, that may be used together in a laundry cycle.

Dishwashing Formulas

A hydrogel or emulsion of dishwashing detergent may preferably contain a mixture of anionic detergents, non-ionic detergents, amphoteric detergents, dissolved and undissolved inorganic salts, fragrance, dyes and may be mixed with other ingredients so as to produce alkalinity builders. Water softening capabilities may also be added.

In addition to the components described above with respect to the laundry detergents, the dishwashing detergents of the present invention may further include a foaming agent and/or foam stabilizer to aid in manual dishwashing. A preferred foaming agent and/or foam stabilizer is cocamidopropyl betaine, and may be present in an amount of between about 1% and about 10%, preferably about 5% by weight.

Formulas described in this invention to use in dishwashing application, by hand or machine, for use in pouches or smaller packets of single or multi-chamber construction, for example, may allow the suspension in a homogenized hydrogel of inorganic salts. The viscosity of the hydrogel may preferably be carefully controlled to maintain the particles of salt in suspension, for otherwise the final packaged product may not have the same salt content in all packets, resulting in more or less viscous final products and potentially creating stability problems in the final product, such as, for example, salting out and phase separation. The dishwashing formulas, preferably the lower viscosity version, Formula 2 as described herein, when packaged in single use dose in water-soluble film, may also be packaged in dual-chamber packets so that one of the chambers contain a silicone-based or other type of defoamer, such as, for example, polyalkylene glycol-based defoamer, to allow for the use of the low foam applications, such as in automatic dishwashing machines, ultrasonic washing machines, and pre-soaking systems.

The following two examples of formulas differ in solid content and viscosity of the hydrogel. They are designed to meet the following criteria:

1—Formula 1 is more concentrated and of higher viscosity than formula 2—higher solid content—which makes it more cost effective for transportation and production, more difficult to package due to the lower fluidity of the hydrogel.

2—Formula 2 is less concentrated is less concentrated and of lower viscosity than formula 1—lower solid content—which makes it less cost effective for transportation and production but easier to package due to the higher fluidity of the hydrogel.

Dishwashing Formula 1 may contain the following ingredients at said stated concentrations:

| Ingredient | CAS No. | % by weight |
|---|---|---|
| Sodium lauryl ether sulfate with 1, 2 or 3 moles ethylene oxide and 30% water by weight | 9004-82-4 | 50 |
| Sodium dodecyl benzene sulfonate, in powder form | 25155-30-0 | 6 |
| Cocamide DTPA | 68855-69-6 | 16 |
| Linear alcohol ethoxylate (C10-12) | 66455-15-0 | 5 |
| Cocamido propyl betaine with 65% water content by weight | 61789-40-0 | 5 |
| Sodium chloride, crystals | 7440-23-5 | 7 |
| Water, soft | 7732-18-5 | 9.6 |
| Fragrance | | 1.4 |
| Dye | | 5 ml/50 lbs of product |

The manufacture procedure may preferably occur in the following order:

1. Add the water to the manufacturing batch.
2. Add the Sodium dodecyl benzene sulfonate, sodium salt, in powder form to the batch and mix until a homogeneous white paste is formed.
3. Add the Cocamide DIPA followed by the linear alcohol ethoxylate (C10-12) and the Cocamido propyl betaine with 65% water content by weight while mixing. A viscous clear to amber colored translucent paste will form.
4. Add the Sodium lauryl ether sulfate with 1, 2 or 3 moles ethylene oxide and 30% water by weight and mix. A very viscous hydrogel will form.
5. Slowly add the Sodium chloride, crystals and mix until there is no indication of clumps.
6. Add the fragrance followed by the dye and mix until the dye is homogeneously dispersed.

The formation of the hydrogel before adding the Sodium chloride crystals may be an important step of the process to obtain the desire dispersion of the crystals throughout the product.

Dishwashing Formula 2 may contain the following ingredients at said stated concentrations:

| Ingredient | CAS No. | % by weight |
|---|---|---|
| Sodium lauryl ether sulfate with 1, 2 or 3 moles ethylene oxide and 30% water by weight | 9004-82-4 | 46.15 |
| Sodium dodecyl benzene sulfonate, sodium salt, in powder form | 25155-30-0 | 5.53 |
| Cocamide DIPA | 68855-69-6 | 14.76 |
| Linear alcohol ethoxylate (C10-12) | 66455-15-0 | 4.61 |
| Cocamido propyl betaine with 65% water content by weight | 61789-40-0 | 4.61 |
| Sodium chloride, crystals | 7440-23-5 | 6.46 |
| Ethanol | 64-17-5 | 8.35 |
| Water, soft | 7732-18-5 | 8.86 |
| Fragrance | | 1.29 |
| Dye | | 5 ml/50 lbs of product |

The manufacture procedure may preferably occur in the following order:

1. Add the water to the manufacturing batch.
2. Add the Sodium dodecyl benzene sulfonate, sodium salt, in powder form to the batch and mix until a homogeneous white paste is formed.
3. Add the Cocamide DIPA followed by the linear alcohol ethoxylate (C10-12) and the Cocamido propyl betaine with 65% water content by weight while mixing. A viscous clear to amber colored translucent paste will form.
4. Add the Sodium lauryl ether sulfate with 1, 2 or 3 moles ethylene oxide and 30% water by weight and mix. A very viscous hydrogel will form.
5. Slowly add the Sodium chloride, crystals and mix until there is no indication of clumps.
6. Add the ethanol and mix to homogenize. The viscosity of the product will decrease.
7. Add the fragrance followed by the dye and mix until the dye is homogeneously dispersed.

The formation of the hydrogel before adding the Sodium chloride crystals may be an important step of the process to obtain the desire dispersion of the crystals throughout the product. Even when the viscosity of the hydrogel decreases after the addition of the ethanol, it still may be high enough to maintain the sodium chloride crystals homogeneously dispersed in the final product. In the formulas described above, Cocamide DIPA may be substituted with Cocamide MIPA, Cocamide DEA, or corresponding lauramides. Ethanol may be substituted by isopropyl alcohol, a mixture of ethanol and propylene glycol and/or a mixture of isopropyl alcohol and propylene glycol. Sodium dodecyl benzene sulfonate in powder form may be substituted by its acid liquid version and neutralized with sodium or potassium hydroxide. Any modification presented herein may have the water content thereof adjusted to achieve a final product within the scope of the present invention of more than about 24% and less than about 30% by weight water. Sodium lauryl ether sulfate with 30% by weight water can be substituted by a version containing water and alcohol, and the formula may be adjusted so that the water content remains within the specified range of more than about 24% and less than about 30% by weight water.

The articles described under Dishwashing Formula 1 and Dishwashing Formula 2 may be packaged in packets of water-soluble film containing between about, for example, 150 grams and 170 grams to be reconstituted into a final volume of 500 ml and 600 ml with tap water, soft water, reverse osmosis produced water, deionized water or distilled water. Larger packets can be produce using stronger films to be reconstituted into 3 to 4 times their weight with tap water, soft water, reverse osmosis produced water, deionized water or distilled water. Reconstitution may produce a viscous ready-to-use Dishwashing Detergent which is appealing to consumers and may be used in squirt-type applications. Also, articles described under Dishwashing Formula 1 and Dishwashing Formula 2 may be packaged in multi-chamber packets of water-soluble film, as described above to be used where low foam conditions are required.

Said packets may be over-packed in re-closable bag made from biodegradable and/or compostable material, printed or non-printed, said over-pack preferably made of layers of films of cellophane, aluminum, paper and/or polylactic acid, each alone or in combination of layers in proportions required to maintain the moisture content of the enclosed environment relatively unchanged, said bags may be biodegradable and/or compostable.

Example of the above article is NatureFlex™ Biodegradable Clear Cello bag manufactured or distributed by Bags & Bows SE Distributors, 2039 Monier Blvd, Lithia Springs, Ga. 30122.

A single bag or multiple bags containing the articles described above may be packaged into a cardboard box for storage, shipping, display and/or to serve as secondary containment and/or moisture protection layer at the point of use, said cardboard box made from non-bleached Kraft® paper coated with a biodegradable coating material to protect the content from moisture and still be biodegradable and/or compostable, said coating material may be wax, preferably from natural sources and/or non-petroleum derived or a synthetic biodegradable material.

An example of the above article includes, but is not limited to, EcoPack manufactured by International Paper, Inc.

Reconstitution System

The concentrated formulas described above for Laundry, Fabric Softening and Dishwashing applications that may be packaged into non-unit dose pouches of single or multi-chamber packets of water-soluble film containing the said formulas, may preferably be reconstituted in water of the quality above described and into volumes exemplified above to make ready-to-use products of desired consumer appeal having said performance, stability, viscosity, color and fragrance.

The present invention further provides a system comprising a container where the product, in water-soluble film pouches of the said formulas, are mixed with water with the assistance of a manual or power operated mixing device, said mixing preferably occurring under the liquid surface, with reciprocal and/or unidirectional motion to produce mixing but preferably avoiding formation of much air bubbles and foam.

The mixing unit may preferably cut the hydrogels being reconstituted into small pieces to permit their rapid dispersion and homogenization to form ready-to-use products. Without the cutting effect of the mixing devise it may take longer for the product to be reconstituted resulting in a less desirable system, such as via using a paddle or a magnetic stirring mixing device.

Example of the System:

A 50 fluid ounces plastic bottle with a 66 mm opening preferably supporting a 4 to 5 fluid ounces volume screw cap. The bottle is marked with a fill line at the 1,500 ml volume.

A 225 grams of Laundry detergent formula 1 contained in a pouch of water-soluble film, as described herein.

Water of the qualities specified under the reconstitution steps under the formulas description, as described herein.

A manual mixing device may be used which produces reciprocating cutting and/or mixing actions when introduced in the pouch/water mixture when pushed down and released back to its original position.

Reconstitution Procedure:

The following procedure may be used to reconstitute all formulas described under Laundry formulas, Fabric Softener formula and Dishwashing formulas, by adjusting the water content to the required volume, as specified herein.

Example of Reconstitution:

1—Into a 50 fluid ounces plastic bottle with a 66 mm opening on top, add a pouch of Laundry formula 1 contained in a water-soluble pouch weighing approximately 225 grams.

2—Fill the bottle with water up to the fill line. The water-soluble film starts to soften and disintegrate.

3—Introduce the mixer, pinching the water-soluble pouch and proceed to mix with a down and up motion.

4—After around 45 seconds of mixing the product is reconstituted. Take out the mixer, cap and invert (do not shake) the bottle two to three times. The product is ready for use It should be noted that various changes and modifications to the presently preferred embodiments described herein will be apparent to those skilled in the art. Such changes and modifications may be made without departing from the spirit and scope of the present invention and without diminishing its attendant advantages. Further, references throughout the specification to "the invention" are nonlimiting, and it should be noted that claim limitations presented herein are not meant to describe the invention as a whole. Moreover, the invention illustratively disclosed herein suitably may be practiced in the absence of any element which is not specifically disclosed herein.

I claim:

1. A concentrated detergent composition comprising:

a formulation contained within a packet of water-soluble film comprising an amount of at least one surfactant and a first amount of water, wherein the water content is between 24% and 30%, and dissolved sodium chloride in an amount up to about 15% by weight of the formulation to decrease the thermodynamic activity of the water within the composition so that the formulation does not dissolve the water-soluble film, and the formulation is a viscous hydrogel comprising suspended crystals of sodium chloride therein.

2. The detergent composition of claim 1, when adding the packet containing the formulation to a second amount of water causes the packet to dissolve within the second amount of water causing the formulation within the packet to be dispersed within the second amount of water and causing the crystals of sodium chloride to dissolve forming a ready-to-use detergent.

3. The detergent composition of claim 2 wherein the ready-to-use detergent has a viscosity between about 400 cP and about 1500 cP.

4. The composition of claim 1 wherein the packet comprises at least two chambers, wherein a first chamber comprises the formulation and the second chamber comprises an amount of sodium chloride necessary to produce a ready-to-use detergent when the packet is dissolved in an amount of water.

5. The packet of claim 4 wherein the ready-to-use detergent has a viscosity between about 400 cP and about 1500 cP.

6. An overpack system comprising the packet of claim 1, wherein the overpack system comprises:

a protective container, wherein the packet is disposed within the container, the protective container configured to prevent environmental moisture from interacting with the packet.

7. The detergent composition of claim 1, wherein the detergent composition is selected from the group consisting of a laundry detergent and a dishwashing detergent.

8. A high foaming formula comprising the detergent composition of claim 1, wherein the detergent composition further comprises a mixture of anionic and non-ionic surfactants.

9. The high foaming formula of claim 7 comprising an amount of defoamer.

10. The high foaming formula of claim 8 wherein the defoamer is silicone-based.

11. A multi-chamber packet comprising at least two chambers, wherein a first chamber comprises the high foaming formula of claim 7 and further wherein a second chamber comprises an amount of defoamer.

12. The multi-chamber packet of claim 11 wherein the defoamer is silicone-based.

13. A reconstitution system comprising the detergent composition of claim 1 and an amount of water, the system comprising:

a preparation bottle and a rotatable wire mixer beneath the water.

* * * * *